US005216957A

United States Patent [19]

Thorsen

[11] Patent Number: 5,216,957

[45] Date of Patent: Jun. 8, 1993

[54] APPARATUS AND METHOD FOR CORRECTING SKEW OF A TRAVELING CRANE BY MAXIMIZING FRICTION BETWEEN LEADING SKEWED WHEEL AND THE RAIL

[75] Inventor: George E. Thorsen, Wauwatosa, Wis.

[73] Assignee: Harnischfeger Corporation, Brookfield, Wis.

[21] Appl. No.: 806,530

[22] Filed: Dec. 13, 1991

[51] Int. Cl.[5] ..... B61F 13/00

[52] U.S. Cl. ..... 105/163.2

[58] Field of Search ..... 105/163.1, 163.2

[56] References Cited

U.S. PATENT DOCUMENTS

| | | | |
|---|---|---|---|
| 3,095,829 | 7/1963 | Dehn | 105/163.2 |
| 5,080,021 | 1/1992 | Thorsen | 105/163.2 |

FOREIGN PATENT DOCUMENTS

| | | | |
|---|---|---|---|
| 745912 | 5/1943 | Fed. Rep. of Germany . | |
| 420537 | 3/1974 | U.S.S.R. | 105/163.1 |
| 998307 | 2/1983 | U.S.S.R. | 105/163.1 |

*Primary Examiner*—Robert J. Oberleitner
*Assistant Examiner*—S. Joseph Morano
*Attorney, Agent, or Firm*—Richard C. Ruppin

[57] ABSTRACT

A skew correcting apparatus for a crane having drive wheels traveling on spaced apart rails which are independently driven. Each one of the drive wheels has an axially extending single diameter cylindrical surface and first and second axially spaced apart radially extending circumferential flanges. The spacing distance of the first flange of each of the first and second wheels is such that, when the crane is in one of the skewed positions the first flange of the leading wheel in the direction of travel engages the faced outer side of the rail head and the engagement of the second flange of the lagging one of the wheels with the inner rail side which it faces is minimized. Each rail head has a shoulder surface including a radius defining a cross-sectional shoulder curvature. The first flange of each one of the wheels also includes a circumferential flange juncture surface adjoining the cylindrical surface. Each flange juncture surface faces a rail head shoulder surface and has a cross-sectional radius such that the flange juncture surface of the leading skewed wheel engages the faced rail head shoulder surface along a cross-sectional line of engagement in each one of the skewed positions. Preferably the radii of the rail head shoulder surface and flange juncture surface are substantially equal so that friction is maximized.

11 Claims, 3 Drawing Sheets

APPARATUS AND METHOD FOR CORRECTING SKEW OF A TRAVELING CRANE BY MAXIMIZING FRICTION BETWEEN LEADING SKEWED WHEEL AND THE RAIL

FIELD OF THE INVENTION

This invention relates to overhead traveling cranes which operate on spaced apart rails and, in particular, to the correction of skewing of such cranes on their rails.

BACKGROUND OF THE INVENTION

Overhead cranes which travel on their wheels along spaced apart generally parallel rails are subject to the continuous problem of a skewing of the crane on the rails. The forces causing skewing are due to rail displacement caused by rail support changes, rail deterioration resulting from improper adjustment of acceleration and deceleration forces of drive motors and brakes, and variations in traction due to rail contamination from moisture vapor and airborne particles. The skewing itself exacerbates the problem since it produces stresses on the rail structure which contribute further to the displacement of the rails. Moreover, the skewing causes severe stressing and wear of the crane wheels. The end result of rail displacement and deterioration and consequent increased skewing is a short wear life of the rails requiring their relatively frequent replacement and very frequent replacement of the wheels.

Various prior art solutions to the skewing problem have been developed. These include controls in which a sensing device is used for detecting skew and adjusting the drive motors of the crane to correct the skew. For example, in a crane having driving wheels at opposite bridge ends of the crane independently driven, slowing the motor of the drive wheel at the leading skewed bridge end will correct the skew. Another approach, upon sensing skew of the bridge, is to either apply a friction drag to the leading skewed end of the bridge or activate a wheel brake on the leading drive wheel of the skewed bridge.

A further solution for cranes having drive wheels driven and controlled independently disclosed in U.S. Pat. No. 3,095,829 to Dehn, is to decrease the clearance between the rail and the outside flange of each of the drive wheels. Consequently, the outside flange of the leading drive wheel, when the crane moves to a skewed position, will contact the outer side of the rail on which it rides and cause that wheel as well as its drive system to slow down due to the resulting friction and thereby correct the skew. The instant invention is an improvement of this skew correction approach.

SUMMARY OF THE INVENTION

It is a general object of the invention to provide a method and apparatus for correcting skew of a traveling crane operating on spaced apart rails in which the drive wheels that rotate on the spaced apart rails are independently driven.

The invention is accomplished by providing a crane supported on spaced apart generally parallel rails by a plurality of wheels including a drive wheel traveling on each of the parallel rails. The drive wheels traveling on the spaced apart rails are independently driven. Each one of the drive wheels has an axially extending single diameter cylindrical surface engaging the top side of a rail head and first and second axially spaced apart radially extending circumferential flange means respectively facing and spaced a distance from the outer side and the inner side of a rail head. The spacing distance of the first flange means of each of the first and second wheels is such that, when the crane is in one of the skewed positions and the leading skewed wheel is toed toward the rail head in the direction of travel of the crane, the first flange means of the leading wheel engages the faced outer side of the rail head and the engagement of the second flange means of the lagging one of the wheels with the inner rail side which it faces is minimized.

Each rail head has a shoulder surface including a radius defining a cross-sectional shoulder curvature. The first flange means of each one of the wheels also includes a circumferential flange juncture surface and adjoining the cylindrical surface. Each flange juncture surface faces a rail head shoulder surface and has a cross-sectional radius such that the flange juncture surface of the leading skewed wheel engages the faced rail head shoulder surface along a cross-sectional line of engagement in each one of the skewed positions of the crane. Consequently, friction is maximized between the faced rail head outer side and the first flange means of the leading skewed wheel to decrease the linear speed of the leading skewed wheel and cause the crane to move to a parallel position.

It is preferable that the flange juncture surface and the rail head shoulder surface which it faces have substantially equal cross-sectional radii. However, the cross-sectional radius of the flange juncture surface may be initially made larger than that of the rail head shoulder surface. Then, after operation of the crane on the rails and wearing due to skew of the flange juncture surface against the rail head, the flange juncture surface will wear to a curvature shape having essentially the same cross-sectional radius of that of the rail head shoulder surface.

BRIEF DESCRIPTION OF THE DRAWINGS

Further objects and advantages of the invention will appear when taken in conjunction with the accompanying drawings, in which.

DETAILED DESCRIPTION OF THE INVENTION

Figure 1:
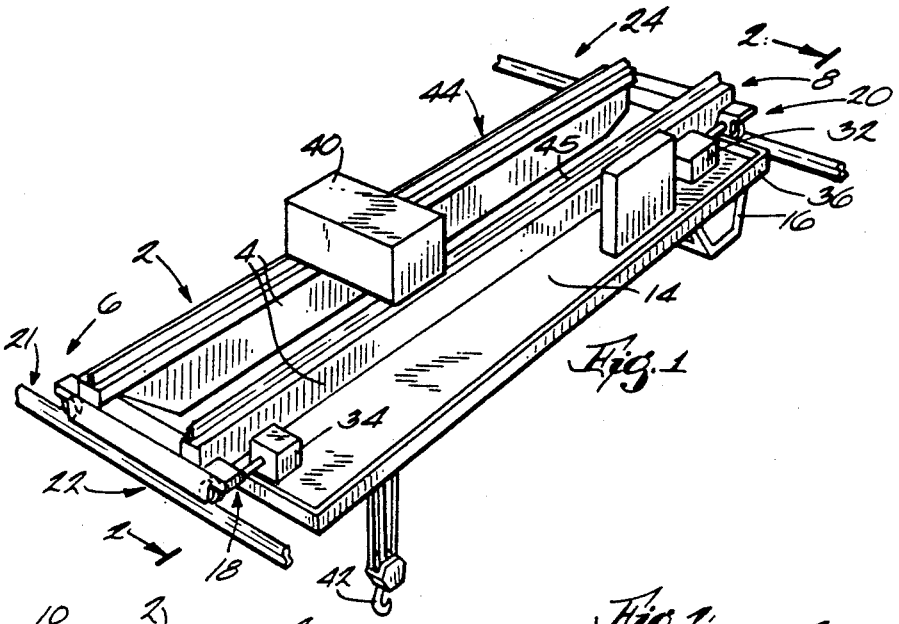
FIG. 1 is a perspective view of a traveling crane incorporating the apparatus of the invention.
Figure 2:
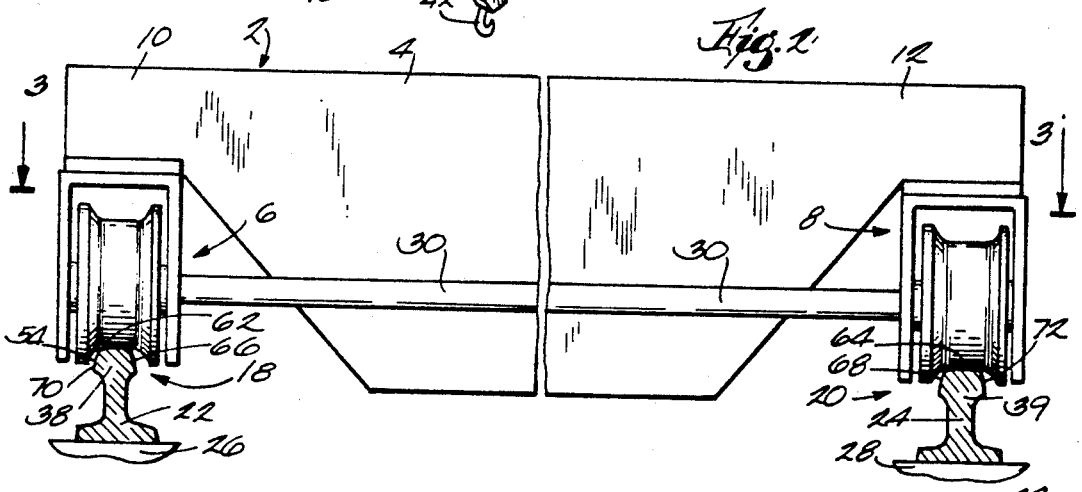
FIG. 2 is a front elevation view, in cross-section taken along lines 2—2 of FIG. 2 and partially broken away, of the crane illustrated in FIG. 1.

Referring generally to FIGS. 1 and 2, an overhead traveling crane is shown as having a frame 2 including a pair of bridge cross-members 4, trucks 6 and 8 respectively at opposite ends 10 and 12 of the cross-members 4, and a footwalk 14. An operator's cab 16 is suspended from the frame 2. Drive wheels 18 and 20 are respectively rotatably mounted on the trucks 6 and 8 in engagement with the rails 22 and 24 so that the latter support the crane. Additional non-driven wheels 21 and 23 are respectively rotatably mounted on the trucks 6 and 8 in engagement with the rails 22 and 24 for support of the crane. The rails are mounted on beams 26 and 28 or other suitable foundation means. The rotatable engagement of the drive and nondriven wheels with the rails 22 and 24 permits travel of the crane along the rails.

Motor drive means 32 rotatably drives the wheel 20 and motor drive means 34 rotatably drives the wheel 18. The drive means 32 and 34 drive the wheels 18 and 20 at the same speed. However, the rotational speed of each wheel is actually independent of the other wheel which permits the wheels to rotate faster or slower relative to each other when either one is subjected to impediments to forward motion. A hoist 40 having a load hook 42 is supported for travel on tracks 44 and 45 which are mounted on the cross-member 4 of the crane. The hoist 40 also includes motors (not shown) for moving the hoist 40 along the tracks 44 and 45 and for raising and lowering the load hook 42. The crane may be operated by well-known controls, not shown, which control the operation of the motor drive means 32, the movement of the hoist 40 on the tracks 44 and 45 and the raising and lowering of the load hook 42.

Figure 4:
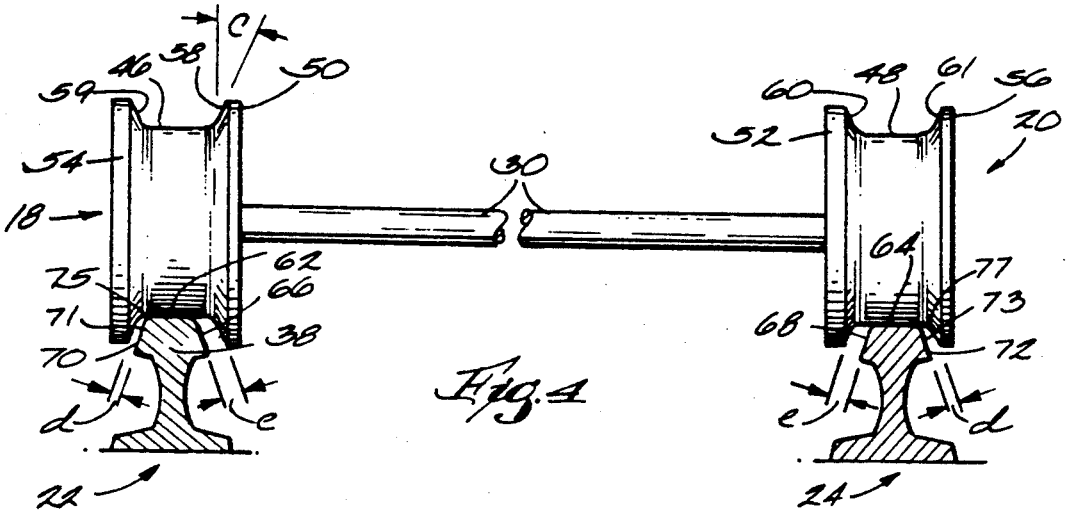
FIG. 4 is a front elevation view showing only the drive wheels of the crane of FIGS. 1-3 on the rails in a parallel, non-skewed traveling position.
Figure 4A:
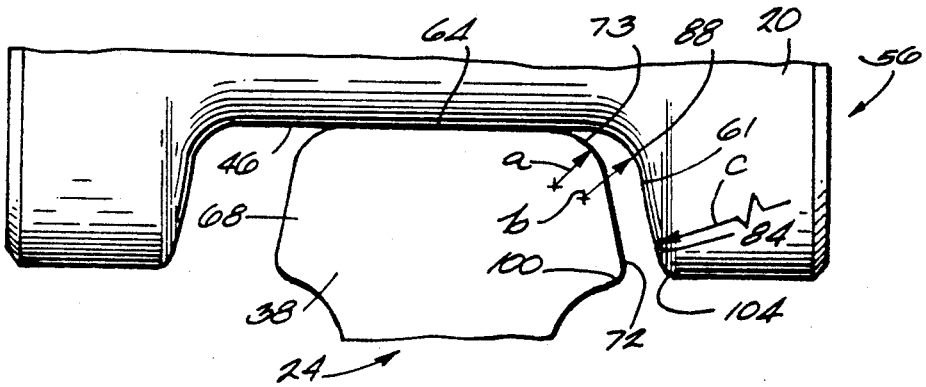
FIG. 4A is an enlarged front elevation view, broken away and illustrating one of the wheels and a rail shown in FIG. 4.
Figure 4B:
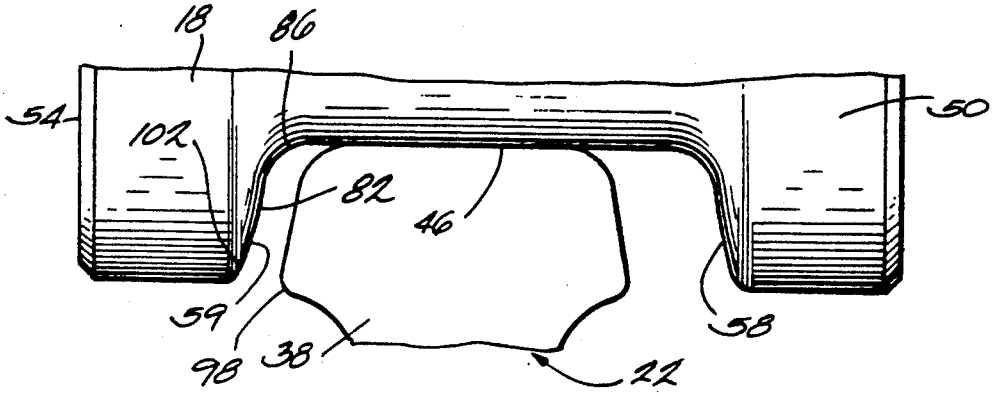
FIG. 4B is an enlarged front elevation view, broken away and illustrating another of the wheels and a rail shown in FIG. 4.

With reference to FIGS. 2 and 4, the drive wheels 18 and 20 are shown engaging rails 22 and 24 in a position in which the crane is traveling in a position parallel to the rails 22 and 24. The wheels 18 and 20 respectively include cylindrical surfaces 46 and 48 each having a single diameter along its axial width. The wheels 18 and 20 also respectively include first outside flanges 54 and 56 and second inside flanges 50 and 52. The flanges 54 and 56 each having larger diameters than the diameters of the cylindrical surfaces. The rails 22 and 24 respectively include heads 38 and 39 having top sides 62 and 64, inner sides 66 and 68, outer sides 70 and 72, and lower outside corners 98 and 100. The top sides may have either a flat or a crowned surface. The outer sides 70 and 72 typically are at an angle of zero to fifteen degrees relative to a vertical plane, in a direction downward and away from the rail head or radially outward toward a facing flange. Also, the rails 22 and 24 respectively include rail head shoulder surfaces 71 and 73 respectively joining and positioned between the top side 62 and outer side 70 of the rail head 38 and joining and positioned between the top side 64 and outer side 72 of rail head 39. Each rail head shoulder surface 71 and 73 has a cross-sectional curvature with a radius a as shown in FIGS. 4A and 4B. The inside flanges 50 and 52 of the wheels respectively include radially extending circumferential inside surfaces 58 and 60 which respectively face inner side 66 of rail head 38 and inner side 68 of rail head 39. The outside flanges 54 and 56 of the wheels 18 and 20 respectively include circumferential inside surfaces 59 and 61 which respectively face outer side 70 of rail head 38 and outer side 72 of rail head 39. The wheels 18 and 2 also include circumferential flange juncture surfaces 75 and 77 respectively joining and positioned between the cylindrical surface 46 and the inside surface 59 of flange 54 and joining and positioned between the cylindrical surface 48 and the inside surface 61 of flange 56. The circumferential juncture surfaces 75 and 77 respectively include curved portions 86 and 88 which each have a cross-sectional radius of curvature b substantially equal to the radius a of the facing rail shoulder surface faced by the surfaces 75 and 77, as shown in FIGS. 4A and 4B. Although it is preferable to have the radii a and b equal, it is possible to have the radius b slightly larger, e.g. about 1/16 inch larger than radius a, and still obtain most of the increased engagement benefit of the rail head shoulder and flange juncture surfaces. Further, where the flanges are initially fabricated with radii b at about 1/16 inch larger than the radii a, in many cases the flange juncture surfaces will wear to a radii b equal to radii a.

The inside surfaces 59 and 61 of the flanges 54 and 56 also preferably extend in a radially outward direction and axially away from the rail sides the surfaces 59 and 61 face as shown in FIGS. 4A and 4B. The angle of extension of the surfaces 59 and 61 relative to a vertical plane is preferably the same as the angle of the rail head outer sides which the surfaces 59 and 61 face. In addition, the inside surfaces 59 and 61 of the flanges 54 and 56 include curved portions 82 and 84 respectively connected to flange juncture surfaces 75 and 77 and circumferentially outward curved portions 102 and 104. The curved portions 82 and 84 each have a radius of curvature c larger than that of the flange juncture surface to which they respectively connect and in a reversed curvature direction to that of the connected flange juncture surface. The clearance distance d between the inside surface 61 of the outside flange 56 and the outer side 72 of the rail head 39 is less than the clearance distance e between the inside surface 60 of the inside flange 52 of wheel 22 and the inner side 68 of rail head 39, as can be seen in FIG. 4. The same spacing relationship exists with respect to the flanges of drive wheel 18 and the rail head 38. Desirable clearance distances are, for example, $\frac{3}{4}$ inch for d and $\frac{3}{8}$ inch for e. It should be understood, however, that other clearance distances may be used so long as the clearance distance d between the outside flange of the drive wheel and the rail head is always less than the clearance distance e between the inside flange of the drive wheel and the rail head.

Figure 3:
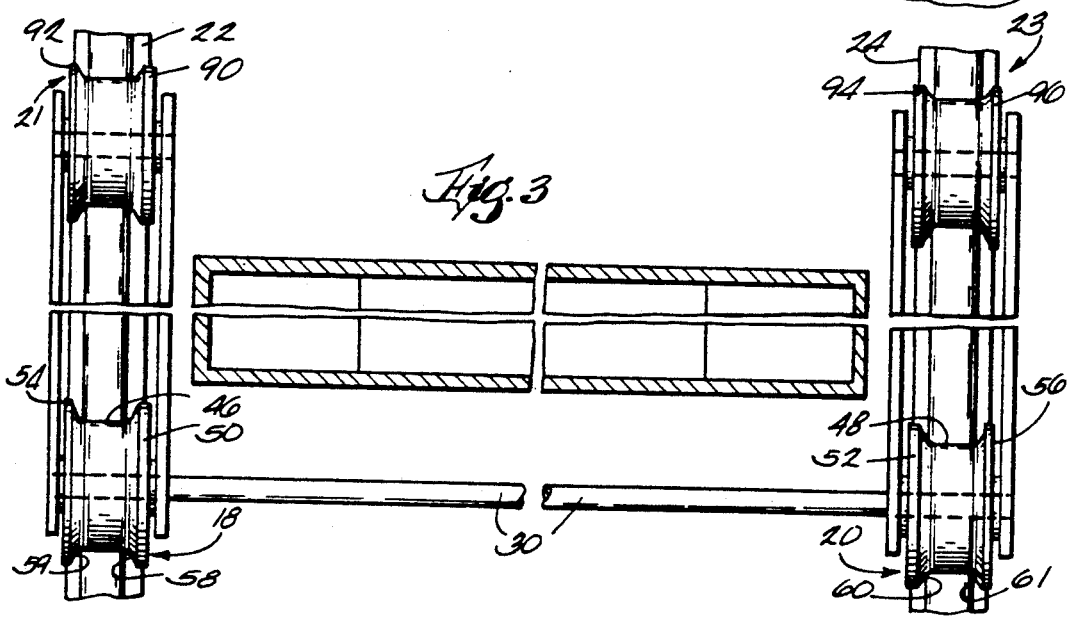
FIG. 3 is a plan view, in cross-section taken along lines 3—3 of FIG. 2 and partially broken away, of the crane illustrated in FIGS. 1 and 2.

The nondriven wheels 21 and 23 are respectively positioned in alignment in the direction of the rails with drive wheels 18 and 20 as shown in FIG. 3. The wheel 21 includes radially extending circumferential flanges 90 and 92 which respectively face and are spaced from the inner side 66 and the outer side 70 of the rail head 38. The wheel 23 includes radially extending circumferential flanges 94 and 96 which respectively face and are spaced from the inner side 68 and the outer side 72 of the rail head 39. The clearance space or distance of both flanges of each wheel 21 and 23 is most desirably at least equal to or greater than the clearance distance e between the inside flange surfaces 58 and 60 and their respective facing inner sides 66 and 68 of the rail heads.

Figure 5:
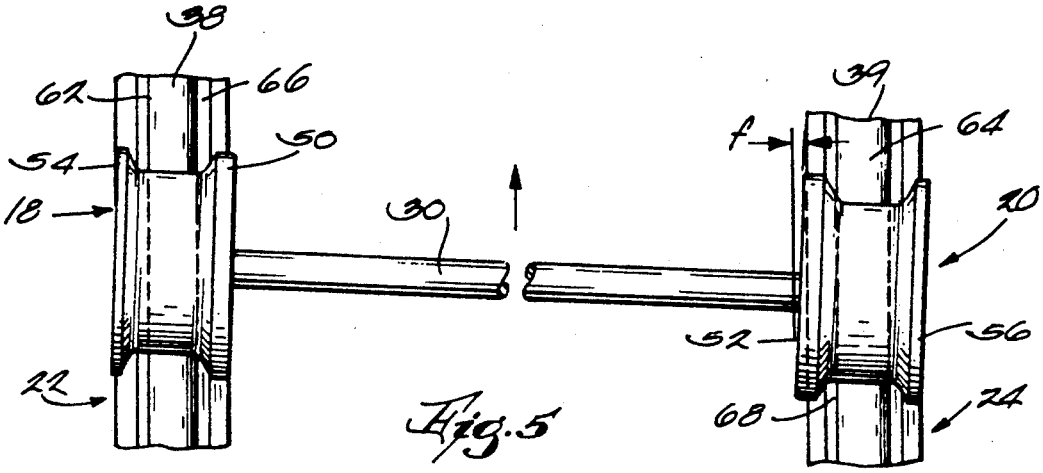
FIG. 5 is a plan view showing only the drive wheels of the crane in a skewed position on the rails with the angle of the skew exaggerated for illustrative purposes.
Figure 6:
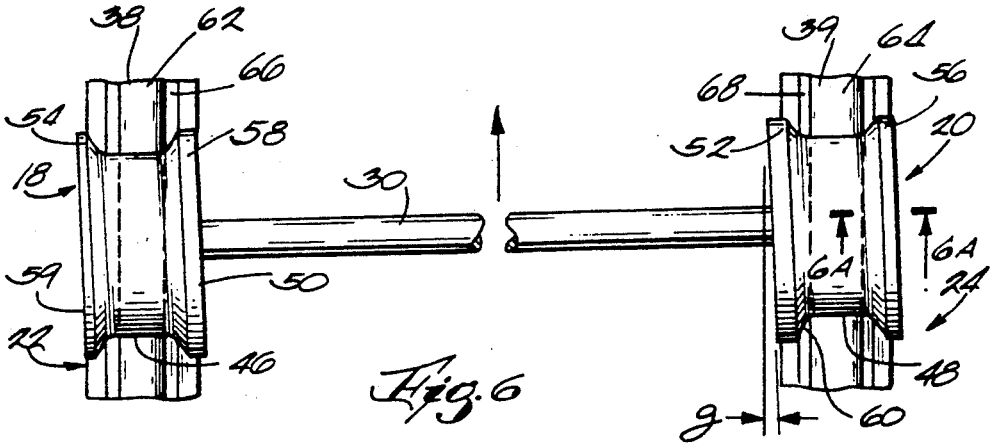
FIG. 6 is a plan view showing only the drive wheels of the crane in a skewed position on the rails opposite to the skewed position shown in FIG. 5 with the angle of the skew exaggerated for illustrative purposes.

The crane has a normally parallel position during its travel in which it moves in a direction parallel to the rails 22 and 24 and the wheels 18 and 20 respectively travel on the rails 22 and 24 in the positions shown in FIG. 3. Although the rails 22 and 24 are generally parallel, they may also in many cases be somewhat displaced from their parallel relationship at various places along their length for the reasons previously discussed. Also, traction of the wheels 18 and 20 on the rails 22 and 24 is affected by moisture, particles or other material on the rails or wheels or both. As a consequence of either lack of rail parallelism or traction problems, if the movement in the direction of crane travel or the rotation of either wheel 18 or 20 is delayed, for example by contact with a side of one of the rails 22 and 24 or by slippage, the position of the delayed wheel will lag the other wheel which will then become the leading wheel. The wheels, and the entire crane, are then considered to be skewed and the extent and angle of the skew is determined by the amount of skew force on the wheels. In FIGS. 5 and 6, the skew angles are designated skew angles f and g for opposite directions of skew. As stated in the description of the drawings, the angle of skew in FIGS. 5 and 6 is exaggerated for illustration purposes herein.

Figure 6A:
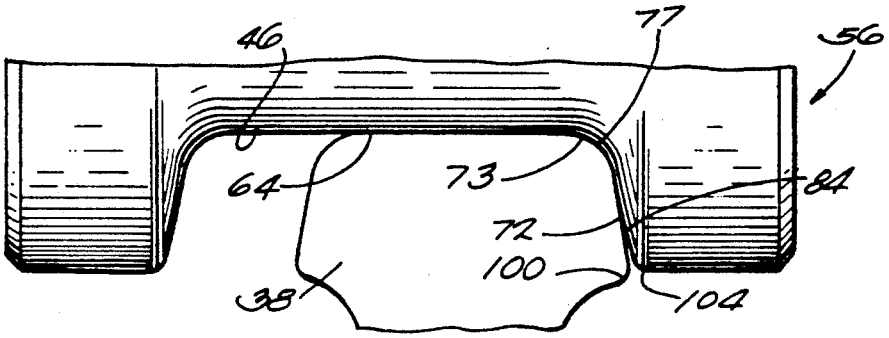
FIG. 6A is a cross-sectional view taken along lines 6A—6A of FIG. 6, broken away and illustrating the leading one of the wheels in the skewed position shown in FIG. 6.

The correction of the skewing is accomplished in accord with the invention in the same way whether the leading wheel is drive wheel 18 or drive wheel 20. Consequently, only the correction of the skewed condition shown in FIG. 6 in which wheel 20 is the leading wheel and wheel 18 is the lagging wheel will be described in detail. With reference to FIGS. 4 and 4A, during relatively straight line travel of the crane, only the cylindrical surface 48 of the wheel 20 and 46 of the wheel 18 are respectively in engagement with the top sides 64 and 62 of the rail heads. The skewing forces on the wheel 20 are such that the shoulder surface 73 of the rail head 39 does not engage the curved portion 88 of the flange juncture surface 77. However, as skew forces increase, the wheel 20 will move to a skewed position in which it is toed toward the rail head 39 in the direction of travel of the crane as shown in FIG. 6 and in which the flange juncture surface 77 engages the rail head shoulder surface 73, continuously along a line of engagement as shown in FIGS. 6 and 6A. The substantially equal radii a and b respectively of the rail head shoulder surface 73 and the flange juncture surface 77 results in a relatively large and maximized line of engagement when the wheel 20 is skewed as shown in FIGS. 6 and 6A. Due to the maximized engagement of the surfaces 73 and 77, an increased relatively large amount of friction and thereby drag force on the wheel 20 is immediately produced upon contact of the surfaces to cause immediate slowing of the wheel 20 and correction of the skew where the skew forces are not too great. Such immediate correction of the skew assists in minimizing wheel and flange deterioration leading to increased skew problems.

If the skew forces are fairly large so that engagement of the equal radii surfaces 73 and 77 do not quickly correct skew, the surface 61 of the flange 56 will move into engagement with the rail head side 72 and the resulting additional friction and drag on the wheel 20 will normally correct extreme skew. The circumferentially outward curved portion 104 of surface 61 away from the rail head side 72 due to its clearance distance greater than distance d from the side 72, avoids skewing engagement and force of the flange 56 against the lower corner 100 of the rail head 39. This is preferable to engagement of the flange with the corner 100 since such force tends to break off the lower rail corner areas.

During skew, the larger clearance distance e of the wheels 18 and 20 in comparison with the clearance distance d minimizes the engagement of the inside flange of the lagging wheel with a rail head side and thereby drag and slowing of the lagging wheel. Such engagement, with reference to the skewed position shown in FIG. 6, would result from the inwardly toed position forward the rail 22 in the direction of crane travel of inside flange 50 of wheel 18 so that the inside surface 58 engages the rail head side 66 with friction force similar to that of surface 61 of wheel 20. With the larger clearance e relative to clearance d, however, such engagement of flange 50 does not occur and thereby leading wheel 20 slows relative to lagging wheel 18 to correct the skew.

An apparatus and method has been described in which skewing of an overhead crane traveling on parallel rails and having drive wheels driven at the same rotational speed will quickly and radially correct the skewed condition. Moreover, the skew correction is accomplished without the need for any additional sensing or corrective apparatus beyond the drive wheels and ordinary drive mechanism of the crane.

It will be understood that the foregoing description of the present invention is for purposes of illustration and that the invention is susceptible to a number of modifications or changes none of which entail any departure from the spirit and scope of the present invention as defined in the hereto appended claims.

What is claim is:

1. In a traveling crane supported on a pair of spaced apart generally parallel rails and including a frame spanning the space between the rails, a truck attached to the frame adjacent each rail, at least one wheel rotatably mounted on each truck in engagement with one of the rails for movement at a linear speed in the direction of the parallel rails whereby the crane travels along and in a position parallel to the rails, the crane also having two oppositely skewed positions while traveling on the rials such that one of the first and second wheels is a leading wheel and the other wheel is a lagging wheel in each of the skewed positions in the direction of travel of the crane, and driving means for rotating a first wheel on one of the trucks and a second wheel on the other of the trucks independently of each other, the combination comprising:

a rail head on each rail, each rail head having a top side, an inner side, an outer side and a rail head shoulder surface joining the top side and the outer side, the rail head shoulder surface including a cross-sectional curvature having a shoulder radius;

each one of the first and second wheels has a single diameter cylindrical surface engaging the top side of the rail head and first and second axially spaced apart radially extending circumferential flange means respectively facing and spaced a distance from the outer side and the inner side of the rail head when the crane is in said position parallel to the rails, the spacing distance of the first flange means of each first and second wheel from the outer side of the rail head which the first flange means of said wheels each face, being such that, when the crane is in one of the skewed positions and the leading skewed wheel is toed toward the rail head in the direction of travel of the crane, the first flange means of the leading one of the first and second wheels engages the faced outer side of the rail head and the engagement of the second flange means of the lagging one of the first and second wheels with the faced inner side of the rail head is minimized; and the first flange means of each one of the first and second wheels further including a circumferential flange juncture surface adjoining the cylindrical surface, each flange juncture surface facing a respective one of the rail head shoulder surfaces and having a cross-sectional radius such that the flange juncture surface of the leading skewed wheel and the respective faced rail head should surface having a cross-sectional line of engagement in each one of the skewed positions of the crane whereby friction is maximized between the faced rail head outer side and the first flange means of the leading skewed wheel to decrease its linear speed and cause the crane to move to said parallel position.

2. The traveling crane according to claim 1 wherein:

each flange juncture surface has an initial different cross-sectional radius than the cross-sectional radius of the rail head shoulder faced by the flange juncture surface; and each flange juncture surface has a cross-sectional radius substantially equal to that of the faced rail head shoulder surface as a result of wearing engagement of each flange juncture surface with the faced rail head shoulder surface during skew of the crane.

3. The traveling crane according to claim 1 wherein each flange juncture surface has a cross-sectional radius substantially equal to the cross-sectional radius of the faced rail head shoulder surface.

4. In a traveling crane supported on a pair of spaced apart generally parallel rails and including a frame spanning the space between the rails, a truck attached to the frame adjacent each rail, at least one wheel rotatably mounted on each truck in engagement with one of the rails for movement at a linear speed in the direction of the parallel rails whereby the crane travels along and in a position parallel to the rails, the crane also having two oppositely skewed positions while traveling on the rails such that one of the first and second wheels is a leading wheel and the other wheel is a lagging wheel in each of the skewed positions in the direction of travel of the crane, and drive means for rotating a first wheel on one of the trucks and asecond wheel on the other of the trucks independently of each other, the combination comprising:

a rail head on each rail, each rail head having a top side, an inner side, an outer side and a rail head shoulder surface joining the top side and the outer side, the rail head shoulder surface including a cross-sectional curvature having a shoulder radius;

each one of the first and second wheels has a single diameter cylindrical surface engaging the top side of the rail head and first and second axially spaced apart radially extending circumferential flange means respectively facing and spaced a distance from the outer side and the inner side of the rail head when the crane is in said position parallel to the rails, the spacing distance of the first flange means of each first and second wheel from the outer side of the rail head which the first flange means of said wheels each face, being such that, when the crane is in one of the skewed positions, and the leading skewed wheel is toed toward the rail head in the direction of travel of the crane, the first flange means of the leading one of the first and second wheels engages the faced outer side of the rail head and the engagement of the second flange means of the lagging one of the first and second wheels with the faced inner side of the rail head minimized;

the first flange means of each one of the first and second wheels further having a circumferential flange juncture surface adjoining the cylindrical surface, each flange juncture surface facing a respective one of the rail head shoulder surface surfaces and having a cross-sectional radius substantially equal to that of the respective faced rail head shoulder surface; and in each one of the skewed positions of the crane, the flange juncture surface of the leading skewed wheel of the first and second wheels engages the faced rail head shoulder surface, such engagement being maximized due to the substantially equal cross-sectional radii of the facing flange juncture surface and rail head shoulder surface, whereby said maximum engagement increases the friction between the facing rail head outer side and the first flange means of the leading skewed wheel to decrease its linear speed and cause the crane to move to said parallel position.

5. The traveling crane according to claim 4 wherein the cross-sectional radius of the flange juncture surface of the first wheel differs from the cross-sectional radius of the rail head juncture surface which the flange juncture surface faces by not more than 1/16 inch.

6. The traveling crane according to claim 4 wherein:

each flange juncture surface has an initial cross-sectional radius larger than the cross-sectional radius of the rail head shoulder faced by the flange juncture surface; and each flange juncture surface has said cross-sectional radius substantially equal to that of the faced rail head shoulder surface as a result of engagement of each flange juncture surface with the faced rail head shoulder surface during skew of the crane.

7. In a traveling crane supported on a pair of spaced apart generally parallel rails and including a frame spanning the space between the rails, a truck attached to the frame adjacent each rail, at least one wheel rotatably mounted on each truck-in engagement with one of the rails for movement at a linear speed in the direction of the parallel rails whereby the crane travels along and in a position parallel to the rials, the crane also having two oppositely skewed positions while traveling on the rials such that a first wheel on one of the trucks and a second wheel on the other of the trucks respectively have a relative leading and lagging position when the crane is in one of the skewed positions and an opposite leading and lagging position when the crane is in the other of the skewed positions, and drive means for independently rotating the first and second wheels, the combination comprising:

at least one of the rails including a head having a top side, an inner side, and outer side and a rail head shoulder surface joining the top side and the outer side, the rail head shoulder surface including a cross-sectional curvature having a shoulder radius;

each one of the first and second wheels has an axially extending single diameter cylindrical surface engaging the top side of the rail head, first and second axially spaced apart flanges respectively facing and spaced a distance from the outer side and the inner side of the rail head when the crane is in said position parallel to the rails, a circumferential flange juncture surface joining the cylindrical surface and the first flange of each first and second wheel, the flange juncture surface facing the rail head shoulder surface and having a cross-sectional flange radius of curvature substantially equal to that of the faced rail head shoulder surface;

the first and second circumferential flanges on each first and second wheel respectively facing and spaced a distance from the outer side and the inner side of the rail head, the distance of the space of the first flange of each first and second wheel from the outer side of the rail head which the first flange of said wheels each face, being less than the distance of the space of the second flange of each first and second wheel from the inner side of the rail head which the second flange of said wheels each face; and the first flange of the leading wheel of the first and second wheels, when the crane is in one of said skewed positions, is toed toward the outer side of the rail head which the first flange faces in the direction of travel of the crane and the facing flange juncture and rail head shoulder surfaces are in engagement with each other due to their substantially equal cross-sectional radii and due to said lesser spacing distance of the first flanges of the first and second wheels whereby a high level of friction develops between the engaged juncture and shoulder surfaces to decrease the linear speed of the leading wheel and correct the skew of the crane.

8. The traveling crane according to claim 7 wherein the cross-sectional radius of at least one of the flange juncture surfaces differs from the cross-sectional radius of the rail head juncture surface which said one flange juncture surface faces by not more than 1/16 inch.

9. The traveling crane according to claim 7 wherein:

at least one of the flange juncture surfaces has an initial cross-sectional radius larger than the cross-sectional radius of the rail head shoulder faced by said one flange juncture surfaces; and said one flange juncture surface has said cross-sectional radius substantially equal to that of the faced rail head shoulder surface as a result of wear engagement of said one flange juncture surface with the faced rail head shoulder surface during skew of the crane.

10. A method for correcting skew of a traveling crane supported on a pair of spaced apart generally parallel rails and including first and second substantially axially aligned wheels each engaging a different one of the rails for movement at a linear speed in the direction of the parallel rails whereby the crane travels along and in a position parallel to the rails, the crane also having two oppositely skewed positions while traveling on the rails such that the first and second wheels respectively have a relative leading and lagging position when the crane is in one of the skewed positions and an opposite leading and lagging position when the crane is in the other of the skewed positions, and drive means for independently rotating the first and second wheels, comprising the steps of:

providing an outwardly facing curved shoulder surface on an outer side of the rail head of each of the pair of rails;

providing each of the first and second wheels with a cylindrical running surface and a flange having a flange surface facing an outer side of a rail head;

providing a flange juncture surface between the cylindrical surface and the flange surface with a curvature substantially equal to that of the curved rail head shoulder surface; and engaging the flange juncture surface of the leading wheel, when the first and second wheels are in one of the skewed positions, with the rail head shoulder surface along the equal curvature surfaces to produce friction force, decreasing the linear speed of the leading wheel and correcting the skew.

11. The method according to claim 10 wherein each shoulder surface has a radius of curvature, comprising the further steps of:

forming each flange juncture surface with a radius of curvature larger than that of curved shoulder surface faced by the flange juncture surface; and rotating the flange juncture surface in engagement with the faced shoulder surface to wear the flange juncture surface to a radius of curvature equal to that of the shoulder surface.

* * * * *